US007441382B2

(12) United States Patent
Beck et al.

(10) Patent No.: US 7,441,382 B2
(45) Date of Patent: Oct. 28, 2008

(54) CLAPBOARD SIDING INSTALLATION CLIP AND METHOD OF INSTALLING CLAPBOARD SIDING

(75) Inventors: David Herbert Beck, Jackson, MI (US); Rick James Morse, Grass Lake, MI (US)

(73) Assignee: Certainteed Corporation, Valley Forge, PA (US)

( * ) Notice: Subject to any disclaimer, the term of this patent is extended or adjusted under 35 U.S.C. 154(b) by 1216 days.

(21) Appl. No.: 10/273,728

(22) Filed: Oct. 18, 2002

(65) Prior Publication Data

US 2004/0074188 A1 Apr. 22, 2004

(51) Int. Cl.
*E04B 2/72* (2006.01)

(52) U.S. Cl. ..... 52/543; 52/547; 52/550; 52/553

(58) Field of Classification Search ..... 52/543, 52/549, 547, 553, 550
See application file for complete search history.

(56) References Cited

U.S. PATENT DOCUMENTS

| | | | | | |
|---|---|---|---|---|---|
| 421,746 | A | | 2/1890 | Mooney | |
| 888,985 | A | | 5/1908 | Finn | |
| 1,510,497 | A | * | 10/1924 | Keller | 52/547 |
| 1,574,099 | A | * | 2/1926 | Kridler | 52/547 |
| 1,978,519 | A | * | 10/1934 | Willock et al. | 52/470 |
| 2,182,372 | A | * | 12/1939 | Cox et al. | 52/547 |
| 2,511,083 | A | * | 6/1950 | Small | 52/547 |
| 2,517,122 | A | * | 8/1950 | Lockwood | 52/548 |
| 2,928,143 | A | * | 3/1960 | Newton | 52/547 |
| 3,757,483 | A | * | 9/1973 | Torbett | 52/522 |
| 3,818,668 | A | * | 6/1974 | Charniga | 52/547 |
| 3,903,670 | A | * | 9/1975 | Robinson, Jr. | 52/478 |
| 3,992,845 | A | * | 11/1976 | Grzesiek et al. | 52/547 |
| 4,079,562 | A | | 3/1978 | Englert et al. | |
| 4,089,141 | A | | 5/1978 | Heroux | |
| 4,314,429 | A | * | 2/1982 | Casteel et al. | 52/127.2 |
| 4,698,942 | A | * | 10/1987 | Swartz | 52/99 |
| 4,854,101 | A | | 8/1989 | Champagne | |
| 4,936,021 | A | | 6/1990 | Frenette et al. | |

(Continued)

FOREIGN PATENT DOCUMENTS

AU 98885 S 12/1987

(Continued)

OTHER PUBLICATIONS

"Standard Test Methods of Conducting Strength Tests of Panels for Building Construction," ASTM, Designation: E72-98, ASTM, Jun. 1998, pp. 539-549.

*Primary Examiner*—Phi Dieu Tran A
(74) *Attorney, Agent, or Firm*—Duane Morris LLP

(57) ABSTRACT

A clip for siding panels installed on a wall of a structure includes a substantially planar nailing face and a seat extending from a bottom edge of the nailing face disposed to receive the bottom edge of an overlapping siding panel. A hook member extends from a top edge of the nailing face and is disposed to hang the clip from a top edge of a siding panel overlapped by the overlapping siding panel. The nailing face is sized to provide a partial overlap of the overlapped siding panel by the overlapping siding panel when the clip is attached to the overlapped siding panel by the hook member and the overlapping siding panel is seated in the seat.

8 Claims, 10 Drawing Sheets

U.S. PATENT DOCUMENTS

| | | | | | |
|---|---|---|---|---|---|
| 5,058,358 | A | * | 10/1991 | Stratton | 52/702 |
| 5,522,149 | A | | 6/1996 | Meyer | |
| 5,564,245 | A | * | 10/1996 | Rademacher | 52/520 |
| 5,634,314 | A | | 6/1997 | Champagne | |
| 6,367,220 | B1 | | 4/2002 | Krause et al. | |
| 6,705,021 | B2 | | 3/2004 | Tiel et al. | |
| 2002/0023366 | A1 | | 2/2002 | Bueno | |

FOREIGN PATENT DOCUMENTS

| | | | | |
|---|---|---|---|---|
| JP | 333749 | * | 11/1992 | 52/543 |
| JP | 333750 | * | 11/1992 | 52/543 |
| JP | 93685 | * | 4/1994 | 52/543 |

* cited by examiner

CLAPBOARD SIDING INSTALLATION CLIP AND METHOD OF INSTALLING CLAPBOARD SIDING

FIELD OF THE INVENTION

The present invention relates to siding products and methods of installing siding products, and more particularly to apparatuses and methods for securing siding panels to structures and to each other.

BACKGROUND OF THE INVENTION

Installing clapboard siding panels, particularly fiber cement clapboard siding panels, presents several problems. First, individual siding panels, although generally durable, are often heavy and awkward to handle, do at least in part to their density, length (up to 12-14') and bendable construction. These factors make one-person installation very difficult, if not impossible. Second, special tools, such as siding jigs, and/or precise measurements are required in order to assure that the panels have the correct amount of lap and subsequent face exposure relative to an adjacent panel.

Typically, panels are installed on a wall of a structure, generally on a sheathing product, in one of two ways—either in a so called "blind nail" method or a so called "face nail" method. In the blind nail method, illustrated by siding panel assembly 20 of FIG. 2, a first siding panel 16*a* is aligned on the face of a wall 12 and a nail (not shown) is driven through the panel 16*a*, generally through an upper region of the exterior face of the panel 16*a*, into the wall 12. A second panel 16*b* is then secured to the wall 12 in the same manner using nail 18. The second panel 16*b* overlaps a portion of the exterior face of the first panel 16*a* and covers the nail or fastener driven through the first panel 16*a*. Another panel (not shown) is then installed overlapping panel 16*b* and covering nail 18. The blind nail method, although aesthetically pleasing, generally provides less wind load resistance (i.e., resistance to detachment from the wall under wind load), when compared with the face nail approach described below. With more brittle siding panels, such as fiber cement siding, smaller face exposure or face nailing is generally required for high load areas.

In the face nailing method shown by panel assembly 10 of FIG. 1, the first siding panel 14*a* is properly aligned on the wall 12. A second siding panel 14*b* is then aligned overlapping the first siding panel 14*a*, as described above, and a nail 18*a* is driven through both siding panels 14*a*, 14*b*, exposing the head of the nail 18*a* at the exterior surface of the second siding panel 14*b*. This process is repeated with subsequent siding courses, such as panels 14*c* and 14*d* shown in FIG. 1, using nails 18*b* and 18*c*. This method provides greater wind load resistance because each panel is secured by twice as many nails when compared with the blind nail method described above, i.e., each nail is driven through two panels (e.g., panels 14*a*, 14*b*) as opposed to just one panel.

Smaller face exposure and/or face nailing are required to meet higher wind load performance requirements. These techniques, however, are undesirable for several reasons. First, the smaller face exposure and exposed nail head are both aesthetically unpleasing. Also, the corrosion resistance of the nail or fastener can diminish over time, leading to rusting and structural breach and discoloration of both the nail or fastener and the panel. Further, the top, overlapping panel, which is pierced by a nail, is exposed to the elements. The interior of the panel can become exposed to moisture, leading potentially to delamination of the laminate clapboard structure. Still further, this exposure increases the chance of failure of the paint finish of the clapboard.

Finally, there is a growing concern in the siding industry regarding "rain screen," which drives the use of furring strips in some situations, which in turn increases the level of difficulty and cost of the installation. The furring strips act to slightly separate the rear face of the siding panels from the wall, creating a slight air gap that helps to equalize air pressure on the front, exterior and rear, interior faces of the siding panels. This helps reduce the amount of moisture that is pulled to the rear face of the siding panel, which can lead to moisture-related problems such as mold growth or wall rotting stemming from collected water or moisture. This gap, which is created by the furring strips, also provides for a rain drip or weep, which helps remove water from behind the rear face of the siding panels.

Australian Registered Design No. AU-S-98885 issued Apr. 14 1987 shows a single "plank fastening clip."

In light of the above, there is a need for a new method and apparatus for installing clapboard siding panels that allow for ease of installation and consistent lap results. Still further, there remains a need for an installation method and apparatus that provides for improved wind load resistance, rain drip and rain screen results, while preserving the life of the installed product and facilitating ease of installation.

SUMMARY OF THE INVENTION

A clip for siding panels installed on a wall of a structure includes a substantially planar nailing face and a seat extending from a bottom edge of the nailing face disposed to receive the bottom edge of an overlapping siding panel. A hook member extends from a top edge of the nailing face and is disposed to hang the clip from a top edge of a siding panel overlapped by the overlapping siding panel. The nailing face is sized to provide a partial overlap of the overlapped siding panel by the overlapping siding panel when the clip is attached to the overlapped siding panel by the hook member and the overlapping siding panel is seated in the seat.

A siding panel assembly and a method of installing siding panel is also provided. A plurality of clips are hung from a top edge of a first siding panel aligned along the surface of a wall. Each clip includes a substantially planar nailing face and a seat extending from a bottom edge of the nailing face and disposed to receive the bottom edge of a second siding panel overlapping the first siding panel. A hook member extends from a top edge of the nailing face and is disposed to hang the clip from the top edge of the first siding panel, wherein the nailing face is sized to provide a partial overlap of the first siding panel by a second siding panel seated in the seat. A bottom edge of the second siding panel is disposed in the seat of each of the plurality of clips. The second siding panel is secured to the wall of the structure.

The assembly clip provides for consistent lap results while simplifying the installation process. The clip can be used in a blind nail assembly technique, providing aesthetic and durability enhancement, while improving wind load resistance. Still further, the clip may be configured to provide air gaps between overlapping siding panels and between an overlapped siding panel and the wall of a structure. This improves air circulation and provides for enhanced rain screen effect and weep.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1:
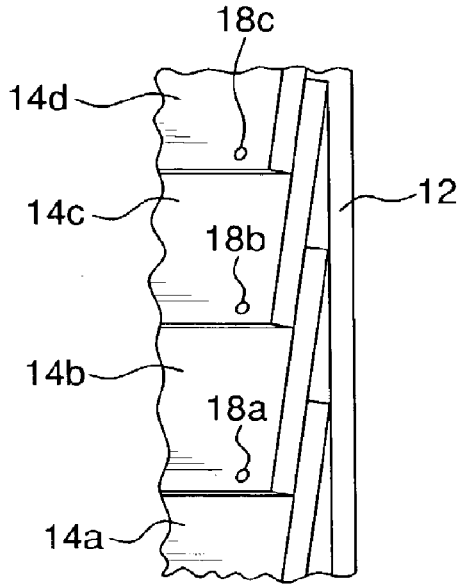
FIG. 1 (PRIOR ART)
FIG. 1 is a partial perspective view of a prior art face nail clapboard panel assembly.
Figure 2:
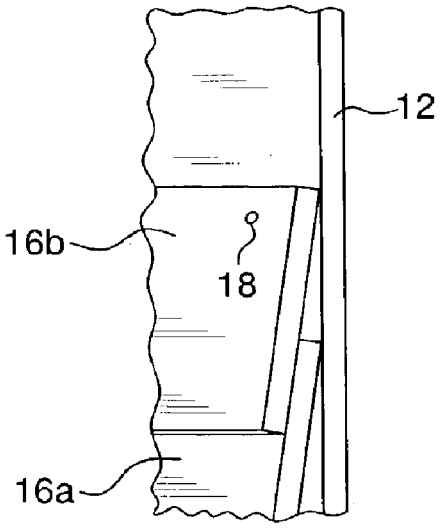
FIG. 2 (PRIOR ART)
FIG. 2 is a partial perspective view of a prior art blind nail clapboard panel assembly.
Figure 3:
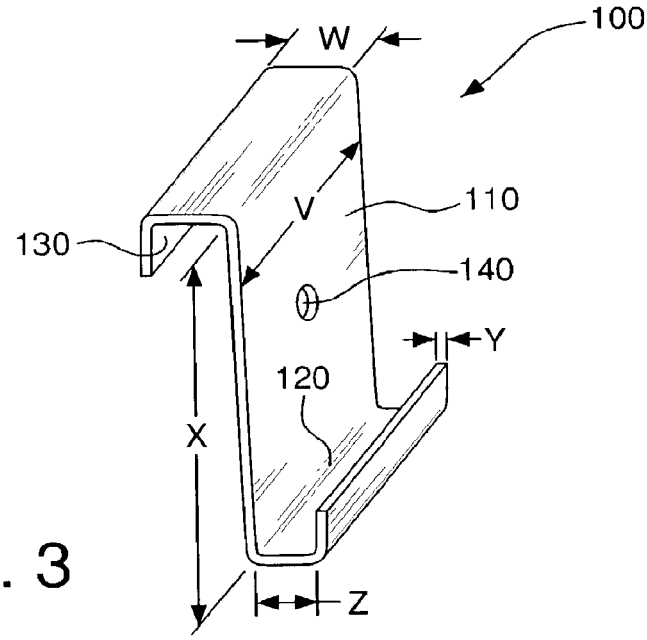
FIG. 3 is a perspective view of an exemplary embodiment of an assembly clip for installing siding panels.

FIG. 3 is a perspective view of a preferred assembly clip 100 for aiding in the installation of siding panels, such as clapboard siding panels, and preferably fiber cement clapboard siding panels, on a wall of a structure. Fiber cement siding panels are usually formed from a composite of cement, pulp fibers, sand, clay, water and optionally a color additive. The assembly clip 100 is generally "S" shaped. The assembly clip 100 is preferably formed from a corrosion resistant material, such as a polymer material or single sheet of aluminum or galvanized steel or a combination thereof. An exemplary clip may be formed from roll-formed aluminum or spring steel.

Assembly clip 100 preferably includes a substantially planar nailing face 110 preferably including an aperture 140 sized to receive a nail or other fastening means, such as a screw. Assembly clip 100 also preferably includes a generally "u" shaped seat 120 extending from a bottom edge of the nailing face 110. The seat 120 is disposed and sized to receive the bottom edge of an overlapping clapboard siding panel (as discussed in more detail below) and should have a width Z slightly greater than the thickness of the bottom edge of the overlapping panel, which, in the case of many clapboard siding panels, is thicker than the top edge of the panel, which is generally in the range of ¼-½ inch.

The assembly clip 100 also can include a generally "u" shaped hook member 130 extending from a top edge of the nailing face 110. The hook member 130 is disposed and sized to allow the clip 100 to hang from the top edge of a siding panel overlapped by the aforementioned overlapping siding panel when the siding panels are aligned on and secured to a structure and the overlapping siding panel is seated in the seat 120. The hook member preferably has a width W slightly greater than the thickness of the top edge of the overlapped siding panel from which it is hung. The thickness of the top edge of clapboard siding panels generally ranges from ¼-½ inch, and is typically approximately 5/16 inch.

The height X of the nailing face 110 is selected to provide the desired overlap between siding panels. For 5-10 inch high siding panels, approximately 1-1.5 inches of overlap between panels is usually desired. In that case, the height X of nailing face 110 may be selected to be approximately 1.25 inches, so that 1.25 inches of overlap is provided when the siding panels are overlapped as shown in FIG. 4 and as described below.

The width V of the nailing face 110 may vary but generally should be in range of ¾-2 inches. The thickness Y of the profile of assembly clip 100 is preferably relatively thin, such as in the range of 0.02-0.04 inches, so as to not detract from the overall aesthetic appearance of the overlapping panels when installed. The assembly clip may optionally be fabricated in various colors so as to match the color of various pre-finished siding panels.

Figure 5:
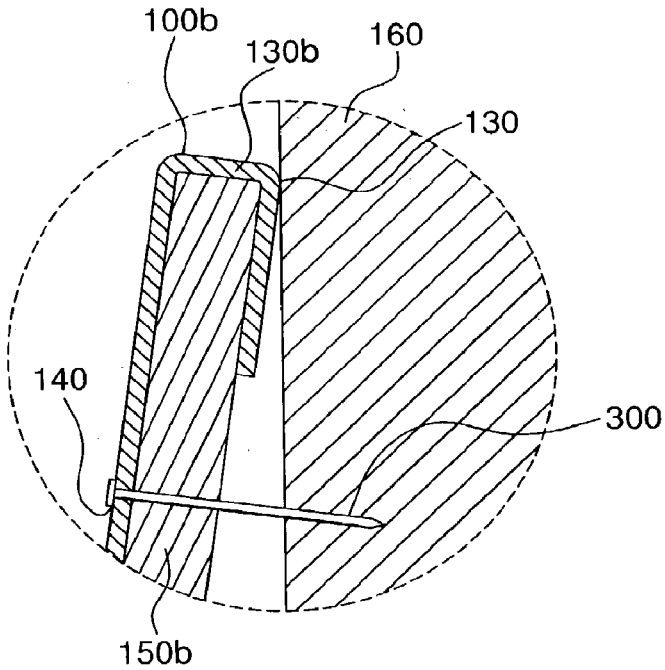
FIG. 5 is an enlarged, cross-sectional view of a portion of the assembly of FIG. 4.
Figure 4:
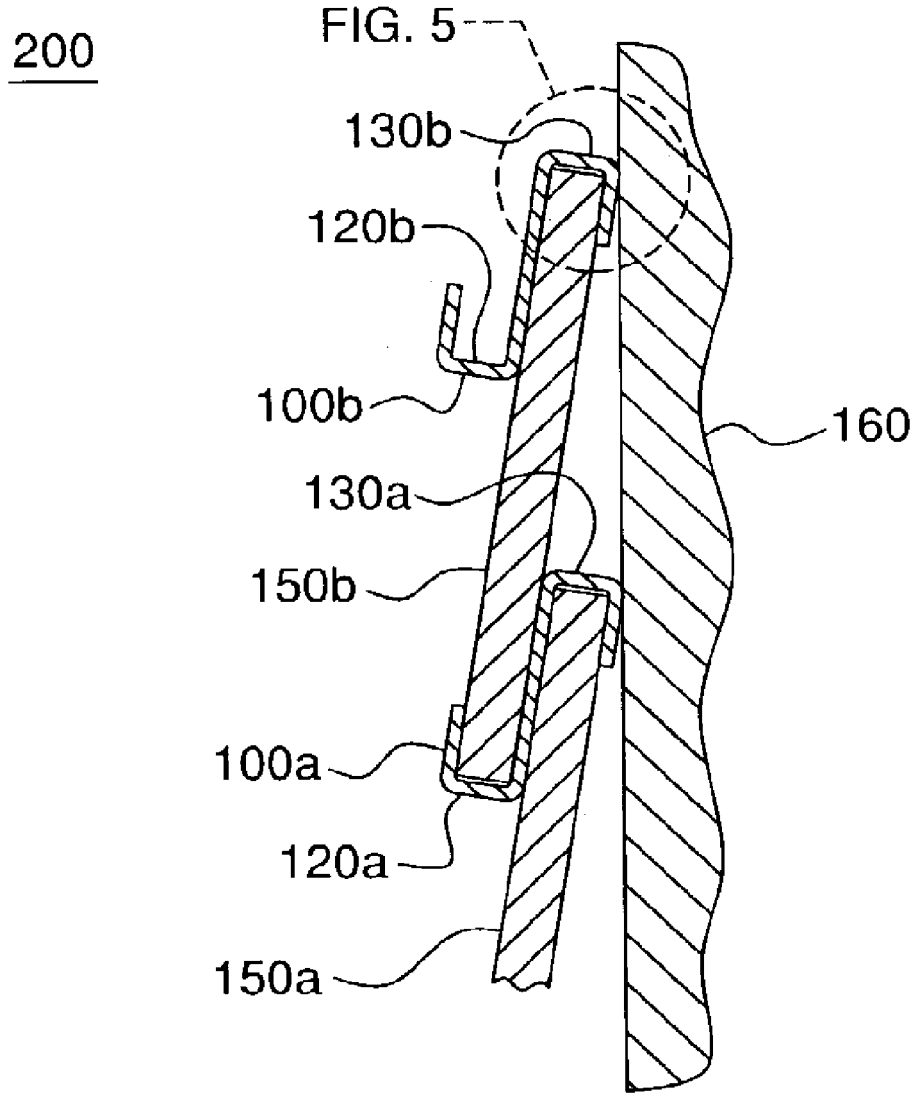
FIG. 4 is a cross-sectional view of a siding panel assembly.

Referring now to FIG. 4, FIG. 4 is a cross-sectional view of a partially assembled siding panel assembly 200. FIG. 5 illustrates an enlarged cross-sectional view of a portion of the assembly 200 of FIG. 4. As best seen in FIG. 4, a first siding panel 150*a* is shown secured to wall 160. An assembly clip 100*a* is shown hung from a top edge of the siding panel 150*a* by the hook member 130*a* of the assembly clip 100*a*. The bottom edge of a second and overlapping siding panel 150*b* is seated in the seat portion 120*a* of assembly clip 100*a*. A second assembly clip 100*b* is shown hung from the top edge of the overlapping siding member by the hook member 130*b* of assembly clip 100*b*. Although not shown, the bottom edge of a third siding panel will be seated in the seat portion 120*b* of siding member 100*b*, and so forth, until the siding panel assembly is completed on wall 160.

The enlarged cross-sectional view of FIG. 5 better illustrates the fastening of the siding panel 150*b* to wall 160. It should be understood that siding panel 150*a* is secured to wall 160 in the same manner. A nail 300, screw or other fastening means is driven or otherwise disposed through the aperture 140, which is optimal, of nailing face 110 of assembly clip 100*b* and through siding panel 150*b* into wall 160 before an overlapping siding panel is seated in seat 120*b* of clip 100*b*.

Figure 6:
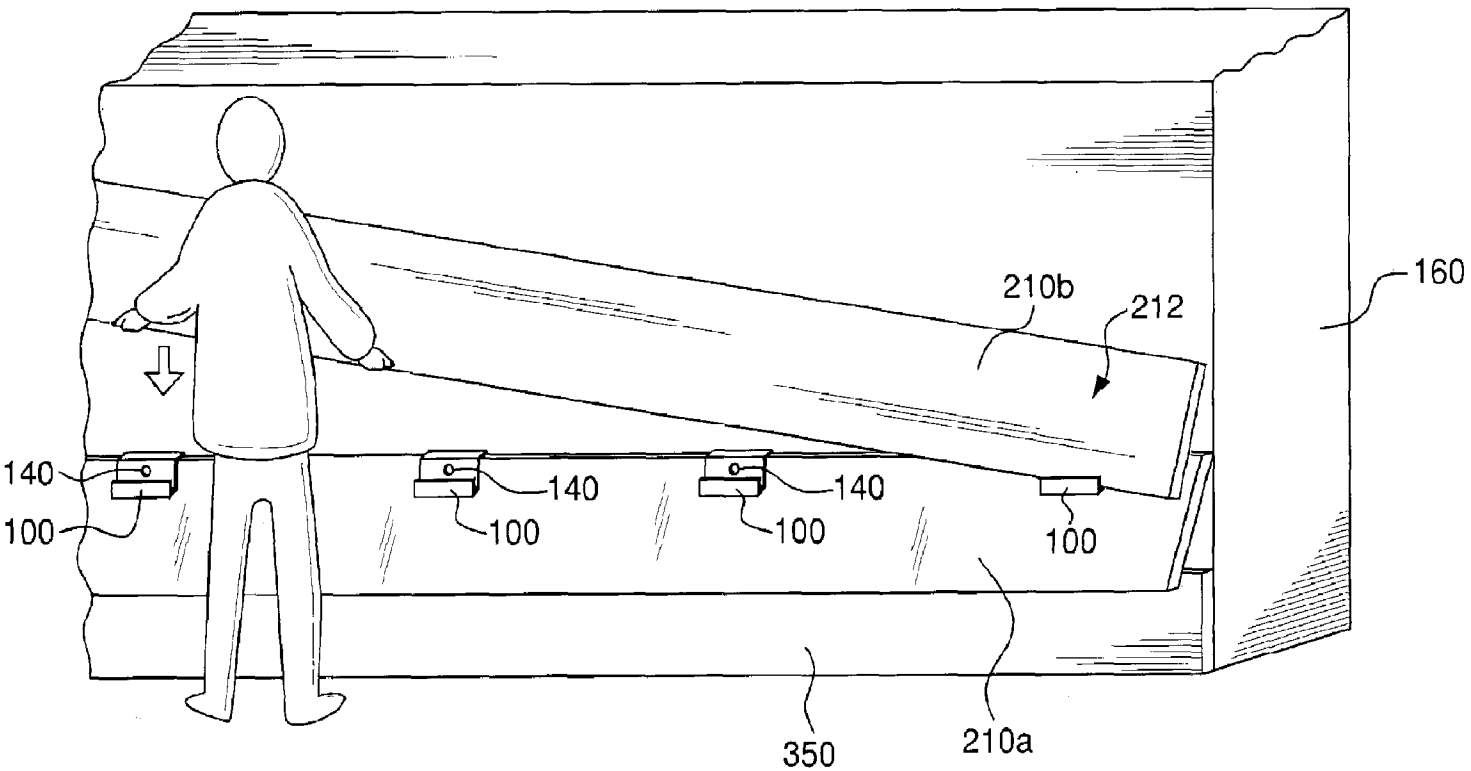
FIG. 6 is an illustration of a partially assembled siding panel assembly being assembled according to an exemplary assembly method of the present invention.

FIG. 6 is provided to help illustrate a method of installing a siding panel assembly on wall 160 using assembly clips 100. A starter strip or board 350, such as a ¼ by 1½ inch furring strip, and comer trim (not shown) are first attached to the wall 160. Optionally, a layer of scrap cement may be laid to form a starter strip. A first clapboard siding panel 210*a* is then properly aligned with respect to starter strip or board 350, such as by overlapping board 350 by a predetermined amount of lap. A siding jig may be used at this point to insure proper overlap and alignment along the length of the board 350. Alternatively, it is contemplated that clips 100 may be employed and secured to board 350 for this purpose. At least two assembly clips 100 are hung from the top edge of the first clapboard siding panel 210*a*. These clips 100 should be placed over studs located in wall 160. These studs may be located using various well known techniques and are typically located every 16-24". The assembly clips may be hung from clapboard siding panel 210*a* at each stud location or at incremental locations along the length of siding panel 210*a*. Each assembly clip is similarly sized (i.e., they have the same height X for nailing face 110) such that the overlap of a second siding panel 210*b* on first siding panel 210*a* is consistent along the length of the siding panel 210*a*.

After the assembly clips 100 are hung from the top edge of first siding panel 210*a*, nails 140 or other fastening means are driven through the assembly clips 100 and first panel 210*a* to secure the panel 210*a* to wall 160, which may have a sheathing product secured thereto. Once the clips 100 and first panel 210*a* are secured, the bottom edge of a second panel 210*b* is seated in the seat portion of the clips 100 hung from the first siding panel 210*a*. This can be easily accomplished by a single individual by placing the bottom edge of the first end of the siding panel (indicated generally by reference 212) in the seat of a first assembly clip 100 as shown so that the second siding panel 210*b* is held at an angled, elevated position as shown. The installer then lowers the second siding panel 210*b* from its angled, elevated position in the direction of the arrow until the bottom edge of the second siding panel is seated in each of the assembly clips 100 hung from the first siding panel 210*a*. Alternatively, the installer can hold the siding panel 210*b* in a central location and simultaneously seat the bottom edge of the panel 210*b* into the seats of clips 100.

At this point, another set of assembly clips (not shown) is hung from the top edge of the seated second siding panel 210*b* in the manner described above. The second siding panel 210*b* and set of assembly clips are then fastened to wall 160 using fastening means, and a third siding panel is then seated in the second set of assembly clips as also described above. This process is repeated until wall 160 is covered with clapboard siding panels.

The assembly clip and method described above provide several advantages. The installation process is simplified, allowing a single person to substantially accomplish the installation while helping to provide a consistent overlap between adjacent, overlapping siding panels. In addition, enhanced wind load resistance is provided despite the use of a pseudo-blind nail technique, which itself provides aesthetic and durability benefits. Wind load resistance is enhanced, it is believed, because the load of the nails or other selected fastening means is distributed across a washer face, i.e., nailing face 110.

Figure 7:
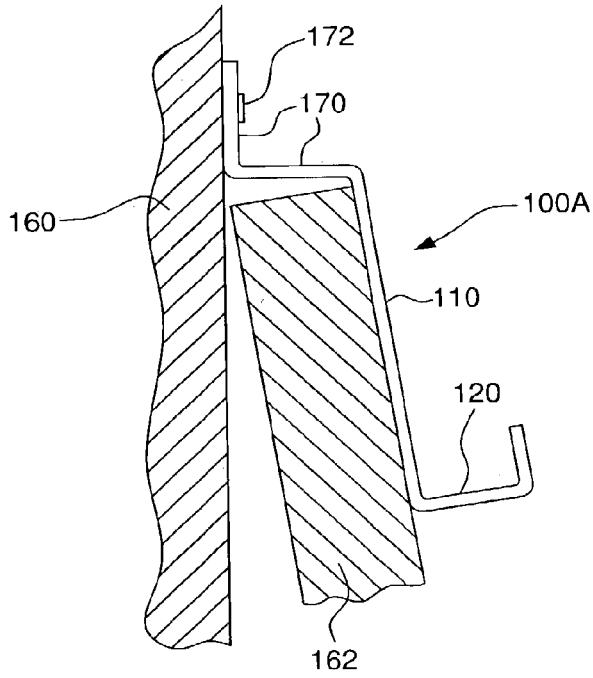
FIGS. 7-7A, 8A-8C, 9 and 10A-10B illustrate alternative embodiments of exemplary assembly clips.

FIG. 7 illustrates an alternative embodiment of an assembly clip. The clip 100A is shown in profile view connected to wall 160 by nail 172, the head of which is shown. The clip 100A is positioned over a top edge of a panel 162. The assembly clip 100A has a seat portion 120 extending from a substantially planar face 110 like assembly clip 100. Clip 100A, however, includes a L-shaped nailing leg 170 extending from a top edge of face 110, as opposed to the hook member 130 of assembly clip 100. Assembly clip 100A is, thereby, fastened relative to the panel 162 directly to wall 160 by fastening means, such as nail 172 disposed through the nailing leg 170 and not the face 110 as shown in FIG. 5. At least the bottom most panel should be affixed to wall 160 by fastening means, as described above, for example, in the "Background of the Invention" section. Subsequent overlapping panels are supported by the seat 120 of the assembly clips and may or may not be separately secured to the wall by fastening means. One advantage of a clip including nailing leg 170 is that, assuming sufficient clips are utilized to adequately support the installed siding panels, the overlapping and overlapped siding panels need not be nailed to the wall of the covered structure. This, in turn, alleviates the potential problems discussed above associated with nailing through clapboard siding panels, particularly fiber cement clapboard siding panels. Adequate wind load resistance of such an assembly may be tested and confirmed using ASTM test, E-72-98, "Standard Test Methods of Conducting Strength Tests of Panels for Building Construction."

Figure 7A:
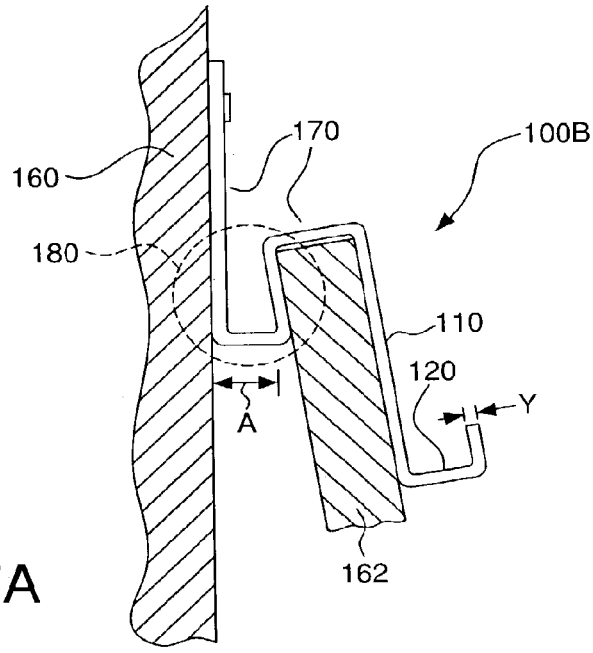

FIG. 7A illustrates another alternative embodiment of an assembly clip. the Assembly clip 100B is the same in all respects to assembly clip 100A, only nailing leg 170 includes a u-shaped or bent intermediate portion 180 that provides an additional gap between the panel 162 and wall 160. This portion 180 preferably provides an additional gap A of 1/18 to ½ inch. Several clips 100B are hung along the top edge of a siding panel 162 to cooperate to provide, in addition to that inherently provided by the thickness Y of assembly clip 100B, a slight air gap between the siding panel and wall 160 along the length of the panel 162. This added air gap helps promote air circulation between the wall 160 and panel 162 and pressure equalization between the front and rear surfaces of the siding panel, thereby providing a rain drip or weep region and addressing rain screen concerns.

Figure 8A:
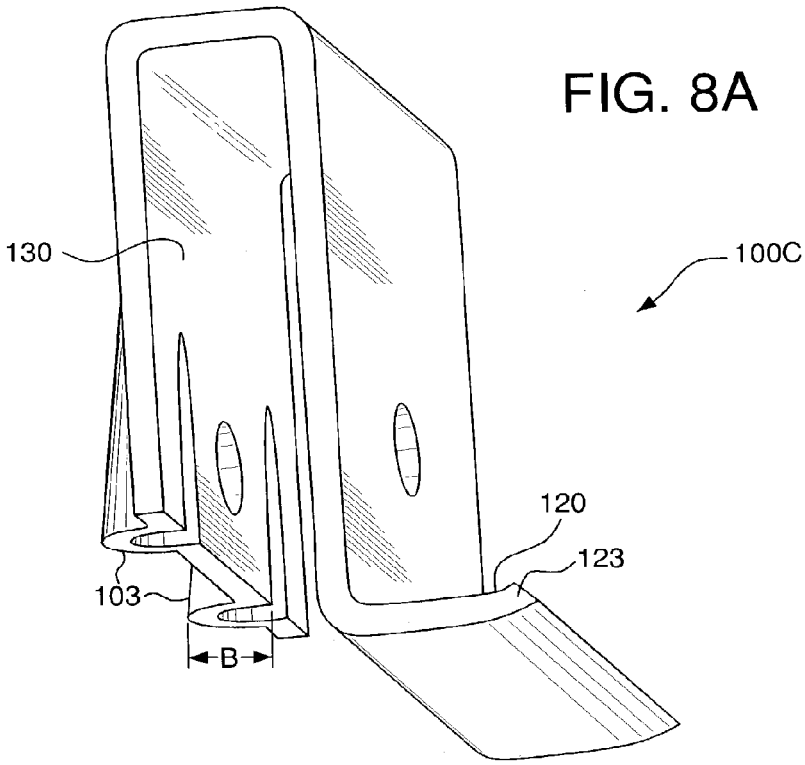
Figure 8B:
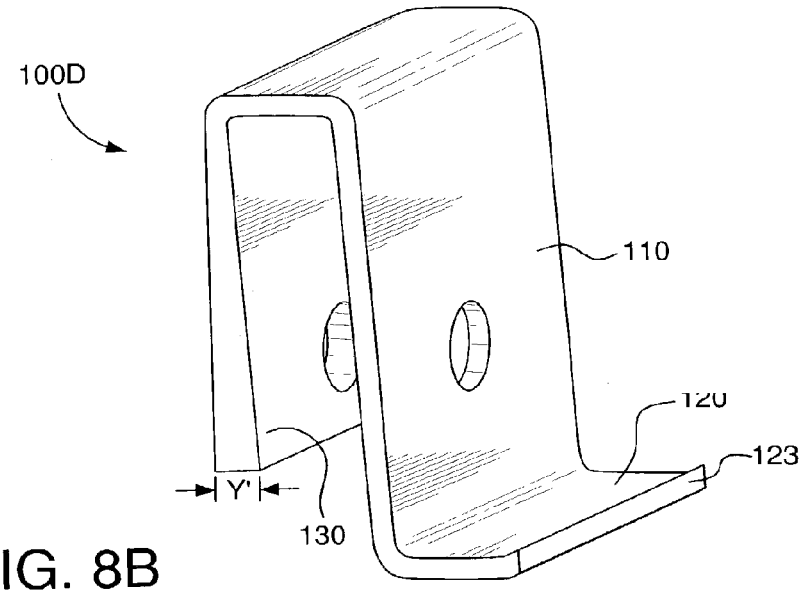
Figure 8C:
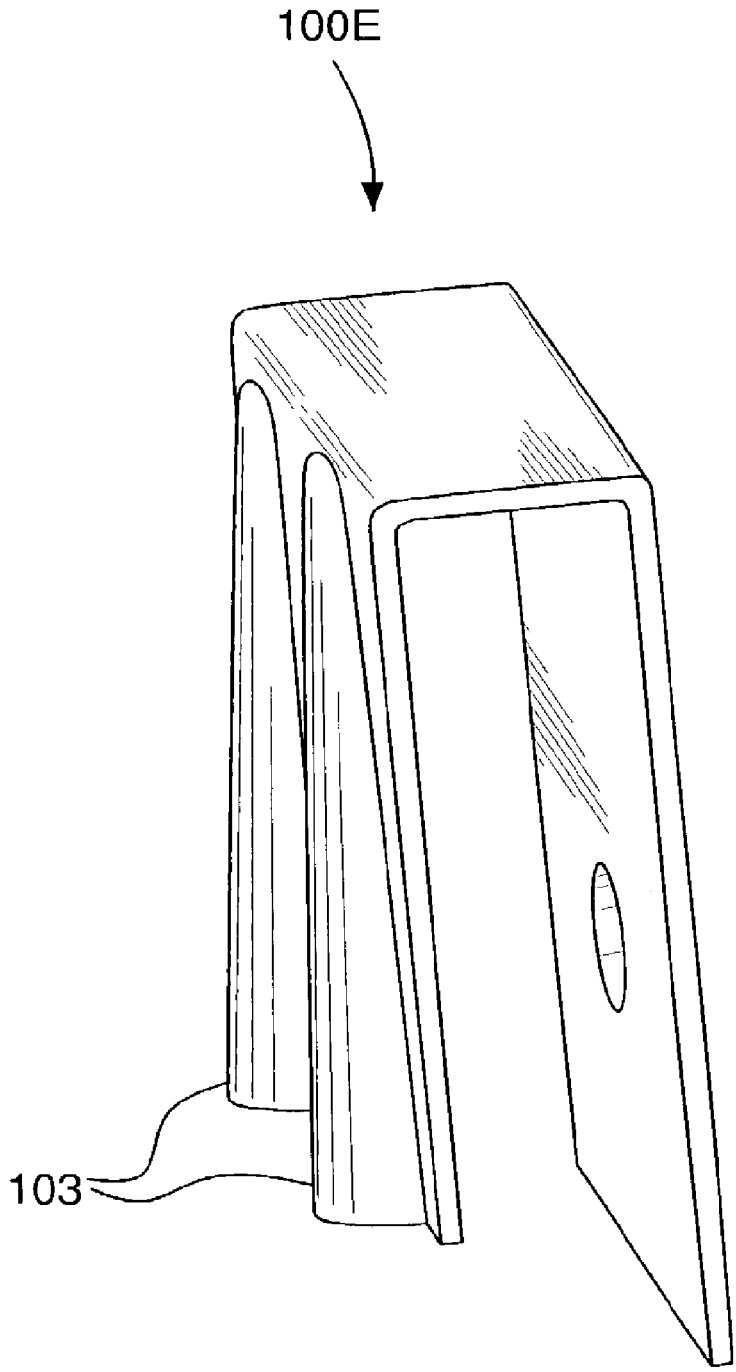

It should be apparent that this forced gap between siding panel 162 and the wall 160 may be provided in several different manners, such as are shown in the perspective views of FIGS. 8A, 8B, and 8C. FIG. 8A is a perspective view of an assembly clip 100C having a hook member 130 for hanging the assembly clip 100C from an overlapped siding panel. The hook member 130 includes protrusions 103 extending from a rear surface thereof. The protrusions 103 may be stamped into the profile to provide the aforementioned forced gap between the overlapped siding panel and the wall. FIG. 8B illustrates another embodiment of an assembly clip. In this embodiment, the hook member 130 of assembly clip 100D has a tapered thickness Y' that provides the forced gap. Protrusions 103 preferably have a generally tapered shape, extending approximately 1/16-3/8 inch from the rear surface of hook member 130 at its end, indicated by dimension B. As also shown in FIG. 8B, the hook member 130 can also extend a length sufficient to include a nailing hole, so that the fastening means (e.g., a nail) extend through both the substantially planar face 110, siding panel, and hook member, thereby providing a double "washer" face resulting in additional support for the siding panel and enhanced wind load resistance. FIGS. 8A and 8B also illustrate that the seat 120 of the assembly clip need not be shaped to lock the overlapping panel into the clip, i.e., the seat 120 can include only a slight upwardly extending lip 123 or no lip at all.

FIG. 8C is provided to illustrate that an assembly clip may be confirmed purely to provide the aforementioned forced gap between the siding panel and the wall. In this embodiment, the assembly clip 100E does not include a seat for an overlapping siding panel. Of course, such an assembly clip would not provide the advantage of controlling the amount of overlap between clapboard panels. The installer preferably, but not necessarily, nails through the clip and the siding product.

Figure 9:
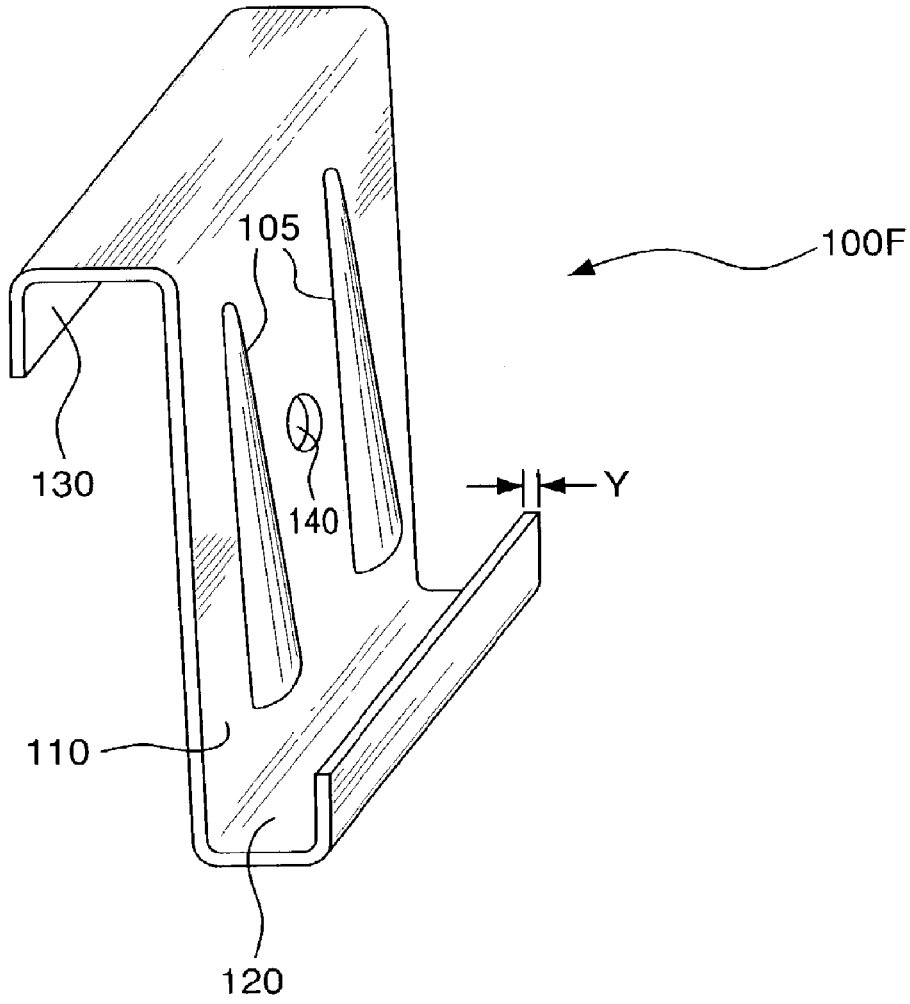

FIG. 9 is a perspective view of another embodiment of an assembly clip. Assembly clip 100F is identical to assembly clip 100 of FIG. 3 except for elevations or protrusions 105 extending from the surface of nailing face 110. These protrusions may be stamped, for example, or otherwise formed in nailing face 110. These protrusions 105 preferably extend approximately 1/16-3/8 inch from the surface of substantially planar nailing face 110. The protrusions of several clips 100A hung from a siding panel cooperate to provide, in addition to that inherently provided by the thickness Y of assembly clip 100A, a slight air gap between an overlapped and overlapping siding panels (such as siding panels 150*a* and 150*b* of FIG. 4) along the length of the overlap. This added air gap helps promote air circulation between the overlapped siding panels and pressure equalization between the front and rear surfaces of each respective siding panel, thereby providing a rain drip or weep region and addressing rain screen concerns.

Figure 10B:
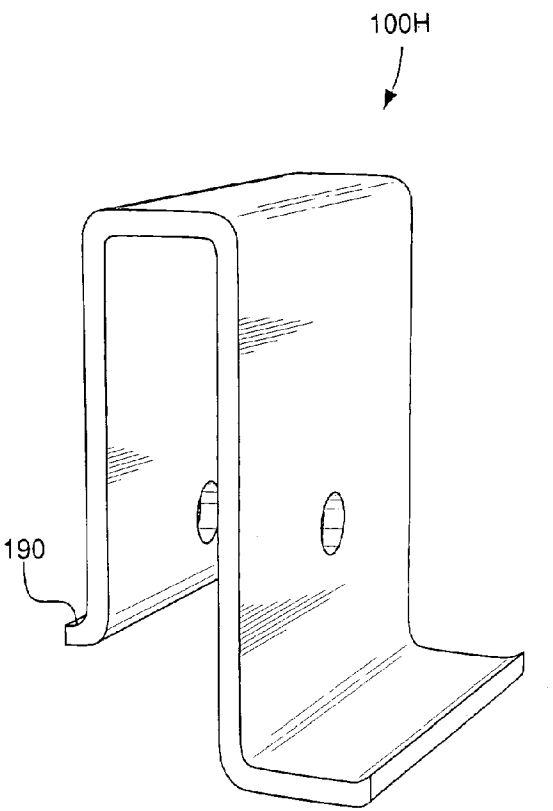
Figure 10A:
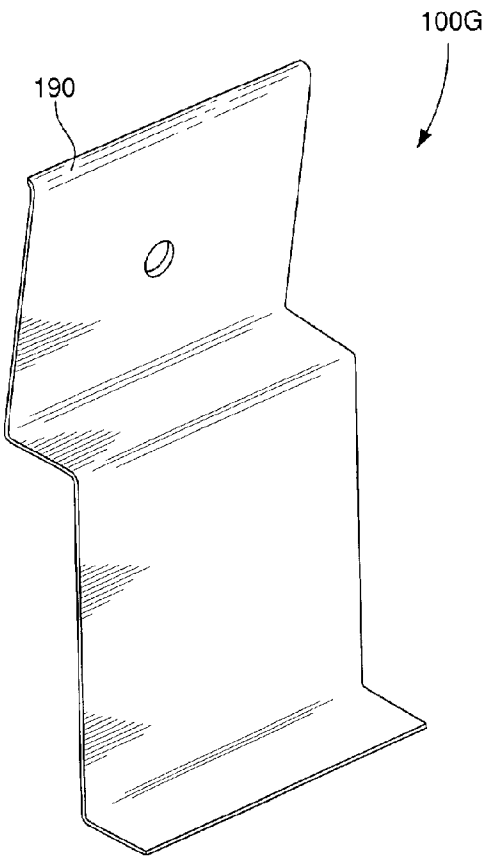

FIGS. 10A-10B illustrate alternative embodiments of the assembly clips that provide a forced gap between the overlapped siding panel and the wall. Each clip 100G, 100H is formed to include a return leg 190 that serves to provide the forced gap (in addition to that inherent in the thickness of the clip) between the wall and the overlapped siding panel during assembly.

It should be understood that clips may be formed using the techniques illustrated in FIGS. 7-7A, 8A-8C, 9 and 10A-10B that provide for both an air gap between the overlapped panels and the wall and an air gap between the overlapping panels and overlapped panels. For example, an assembly clip may include the protrusions 105 of clip 100F (FIG. 9) in combination with the hook member 130 of clip 100C (FIG. 8A), which includes protrusions 103 (or other gap providing means as shown in, for example, FIGS. 7A and 8B). In such an embodiment, the protrusions 105 provide for the added air gap between the overlapped and overlapping siding panels, and the protrusions 103 provide for the added air gap between the overlapped siding panels and the wall. Similarly, clips may be formed using various techniques for securing the clip relative to the top edge of an overlapped siding panel, such by a nailing leg (as shown in, for example, FIG. 7), a hook member (as shown in, for example, FIGS. 3 and 8A-8C) or combination hook member and nailing leg (as shown in, for example, FIG. 7A).

Figure 11:
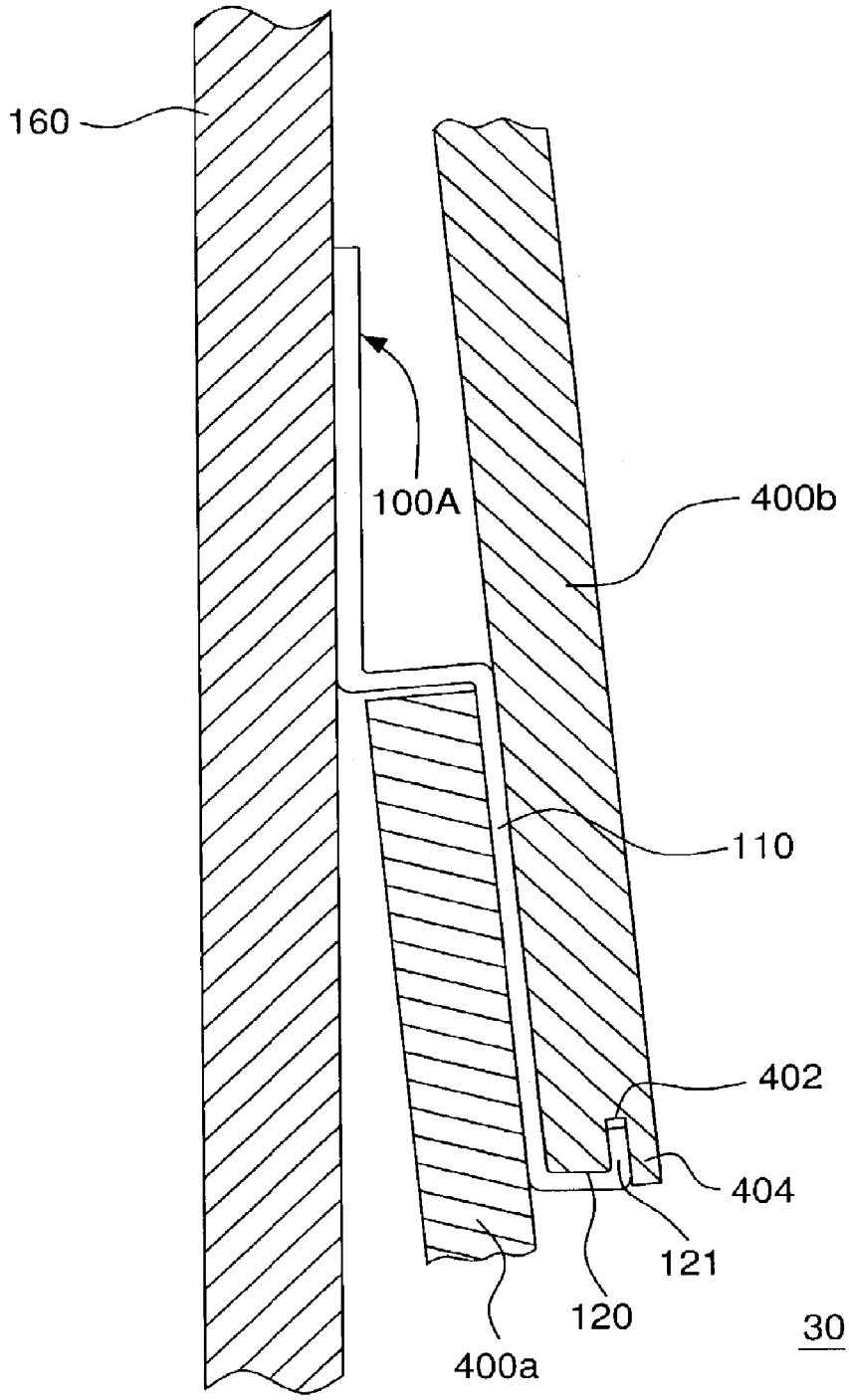
FIG. 11 illustrates an exemplary clip and siding system for hiding a seat ledge of the clip.

FIG. 11 is a side elevational view of an alternative siding assembly 30 that provides increased strength and aesthetic effects. An assembly clip, shown as clip 100A, is fastened to a wall 160. The clip 100A may take the form of any clip described herein, as long as the clip includes a seat portion 120 including a return leg 121 that is substantially parallel with the planar face 110 of the clip and shaped to fit into slot or recess 402 of the overlapping panel 400*b*, as shown. Panels 400*b*, 400*a* in the siding assembly of FIG. 11 preferably include recess 402, which can extend along the entire length of the panel 402 or a plurality of recesses may be periodically spaced along the bottom edge of the panel. Front portion 404 of the panels preferably extends to cover the return leg 121 of the seat. In this manner, the seat portion 120 of the assembly clip does not detract from the overall appearance of the siding panel assembly. Still further, the male-female relationship of the return leg 121 and the recess 402 adds additional wind load resistance. The assembly 30 may be assembled in a manner similar to that described above in connection with FIG. 6, only with the return leg 121 fitted into the recess 402 of the panel 400*b*. Obviously, how the assembly clip is secured relative to the top edge of the overlapped siding panel 400*a* is determined by the clip selected for the assembly.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention

What is claimed is:

1. A siding panel assembly, comprising:

first and second siding panels, said second siding panel partially overlapping said first siding panel;

at least two spaced clips hung from a top edge of said first siding panel, each clip including:

a front nailing face having a first nailing aperture formed therethrough;

a seat extending from a bottom edge of said nailing face disposed to receive the bottom edge of said second siding panel; and a hook member extending from a top edge of said nailing face and disposed to hang said clip from said top edge of said first siding panel, said hook member comprising a return leg extending substantially parallel to said front nailing face and having a second nailing aperture formed therethrough and aligned with said first nailing aperture, wherein said nailing face is sized to provide said partial overlap of said first siding panel by said second siding panel seated in said seat; and fastening means for securing said first siding panel to a wall of a structure, said fastening means disposed through said first and second nailing apertures of each of said spaced clips and through said first siding panel wherein said hook member includes at least one protrusion thereon disposed to provide an air gap between said first siding panel and said wall, said at least one protrusion comprising at least one vertical protrusion having a thickness tapered along its length.

2. The assembly of claim 1, wherein said clip further comprises at least one protrusion extending from said nailing face and disposed to provide an air gap between said first siding panel and said second siding panel.

3. The assembly of claim 1, wherein said hook member is generally "u" shaped.

4. The assembly of claim 1, wherein said seat is generally "u" shaped.

5. The assembly of claim 1, wherein said hook member has a width approximately equal to the thickness of atop edge of said first siding panel and said seat has a width approximately equal to the thickness of a bottom edge of said second siding panel.

6. The assembly of claim 1, wherein said siding panels are fiber cement clapboard siding panels.

7. The assembly of claim 1, wherein said at least one protrusion comprises at least one protrusion stamped into the profile of said book member.

8. The assembly of claim 1, wherein said at least one protrusion comprises a pair of vertical protrusions disposed on either side of said second nailing aperture.

* * * * *

UNITED STATES PATENT AND TRADEMARK OFFICE

CERTIFICATE OF CORRECTION

PATENT NO. : 7,441,382 B2
APPLICATION NO. : 10/273728
DATED : October 28, 2008
INVENTOR(S) : David Herbert Beck It is certified that error appears in the above-identified patent and that said Letters Patent is hereby corrected as shown below:

At Col. 8, Line 43; delete "book" and substitute therefore --hook--

Signed and Sealed this

Thirtieth Day of December, 2008

JON W. DUDAS
*Director of the United States Patent and Trademark Office*